US009074600B2

(12) United States Patent
Karino et al.

(10) Patent No.: US 9,074,600 B2
(45) Date of Patent: Jul. 7, 2015

(54) ROTARY COMPRESSOR

(75) Inventors: Tsuyoshi Karino, Shiga (JP); Daisuke Funakoshi, Shiga (JP); Noboru Iida, Shiga (JP); Kiyoshi Sawai, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 134 days.

(21) Appl. No.: 13/808,030

(22) PCT Filed: Jun. 29, 2011

(86) PCT No.: PCT/JP2011/003717

§ 371 (c)(1),
(2), (4) Date: Jan. 2, 2013

(87) PCT Pub. No.: WO2012/001966

PCT Pub. Date: Jan. 5, 2012

(65) Prior Publication Data

US 2013/0101454 A1 Apr. 25, 2013

(30) Foreign Application Priority Data

Jul. 2, 2010 (JP) ..... 2010-151805

(51) Int. Cl.
*F04C 18/04* (2006.01)
*F04C 18/324* (2006.01)
*F04C 29/00* (2006.01)

(52) U.S. Cl.
CPC ..... *F04C 18/04* (2013.01); *F04C 18/324* (2013.01); *F04C 29/0057* (2013.01); *F04C 2240/60* (2013.01)

(58) Field of Classification Search
CPC .. F04C 18/324; F04C 18/322; F04C 18/3564; F04C 15/042; F04C 2/32; F04C 29/0021; F04C 2240/20; F04C 2240/60; F04C 2250/20
USPC ..... 418/62, 63, 64, 66, 67, 162, 181, 182, 418/151
See application file for complete search history.

(56) References Cited

U.S. PATENT DOCUMENTS 2,800,274 A * 7/1957 Makaroff et al. ..... 418/67
2,929,550 A * 3/1960 Sadler ..... 418/67

(Continued)

FOREIGN PATENT DOCUMENTS

CN 1802509 7/2006
CN 101498307 8/2009

(Continued)

*Primary Examiner* — Mary A Davis
*Assistant Examiner* — Jason T Newton
(74) *Attorney, Agent, or Firm* — Hamre, Schumann, Mueller & Larson, P.C.

(57) ABSTRACT

In a rotary compressor of a vane rotary type, an outer peripheral surface of an eccentric portion of a shaft on a side adjacent to a center of the shaft is located radially inwardly of an outer peripheral surface of a main shaft inserted in a main bearing and that of an auxiliary shaft inserted in an auxiliary bearing. Also, a back clearance means used in mounting a piston on the shaft is provided in each of an inner peripheral surface of the piston and the eccentric portion of the shaft. Such configurations can reduce a diameter of the eccentric portion. A reduction in diameter of the eccentric portion can reduce a viscous force of oil acting between the eccentric portion of the shaft and the inner peripheral surface of the piston to thereby reduce a rotational moment about a center of the eccentric portion of the shaft, which rotational moment acts on the piston in a direction of rotation of the shaft, thus making it possible to reduce a sliding loss that is generated by a reciprocating motion of a vane in a vane groove.

5 Claims, 5 Drawing Sheets

(56) References Cited

U.S. PATENT DOCUMENTS

| | | | | |
|---|---|---|---|---|
| 4,636,152 | A * | 1/1987 | Kawaguchi et al. | 418/54 |
| 5,641,279 | A * | 6/1997 | Yamamoto | 418/66 |
| 6,206,661 | B1 * | 3/2001 | Iida et al. | 417/462 |
| 6,409,488 | B1 * | 6/2002 | Ikoma et al. | 418/67 |
| 7,186,100 | B2 * | 3/2007 | Cho et al. | 418/94 |
| 7,556,484 | B2 * | 7/2009 | Doi et al. | 418/66 |
| 2006/0153723 | A1 * | 7/2006 | Kurita et al. | 418/29 |
| 2010/0147013 | A1 * | 6/2010 | Hirayama | 62/401 |

FOREIGN PATENT DOCUMENTS

| | | | | |
|---|---|---|---|---|
| CN | 101688535 | | 3/2010 | |
| JP | 61-108887 | | 5/1986 | |
| JP | 1987-171682 | | 10/1987 | |
| JP | 64-3290 | | 1/1989 | |
| JP | 2008-180178 | | 8/2008 | |
| JP | 2009180203 | A * | 8/2009 | F04C 23/00 |
| JP | 2010-101169 | | 5/2010 | |
| WO | WO 2010/073426 | | 7/2010 | |

* cited by examiner

ROTARY COMPRESSOR

TECHNICAL FIELD

The present invention relates to a rotary compressor that is incorporated into a refrigerator, an air conditioner or the like.

BACKGROUND ART

As shown in FIGS. 7 and 8, a conventional rotary compressor includes a closed container 1, an electric motor (not shown) accommodated within the closed container 1, and a compression mechanism A similarly accommodated within the closed container 1 and connected to the electric motor via a shaft 4. An oil sump is formed in the closed container 1 at a bottom portion thereof. The compression mechanism A includes a cylinder 5 having a radially extending vane groove 10 defined therein, a main bearing 7 and an auxiliary bearing 8 secured respectively to opposite end surfaces of the cylinder 5 to define a cylinder chamber 6, a shaft 4 having an eccentric portion 41 formed between the main bearing 7 and the auxiliary bearing 8, a piston 9 mounted on the eccentric portion 41 of the shaft 4, and a vane 11 loosely inserted in the vane groove 10 for a reciprocating motion thereof. The vane 11 has a distal end 11A hingedly connected to a joint 9A formed in the piston 9 to partition the cylinder chamber 6 into a suction chamber 12 and a compression chamber 13.

Rotation of the shaft 4 is followed by an orbital motion of the piston 9 and a reciprocating motion of the vane 11, both of which in turn cause a change in volume of the suction chamber 12 and a change in volume of the compression chamber 13. Such volumetric changes compress a working refrigerant, inhaled into the suction chamber 12 through a suction port 17, into a high-temperature and high-pressure refrigerant, which is discharged from the compression chamber 13 into the closed container 1 through a discharge port 18 and a discharge muffler chamber 19. At the same time, oil stored in the oil sump is sucked by an oil pump mounted on a lower end of the shaft 4 and passes through a through-hole defined in the shaft 4. The oil is then supplied to and lubricates sliding surfaces in the compression mechanism A such as, for example, those between the eccentric portion 41 of the shaft 4 and an inner peripheral surface 9B of the piston 9 and those between an outer peripheral surface of the piston 9 and an inner peripheral surface of the cylinder 5 (see, for example, Patent Document 1).

In the above-described conventional rotary compressor, as shown in FIG. 9, a viscous force of the oil acting between the eccentric portion 41 of the shaft 4 and the inner peripheral surface 9B of the piston 9 generates a rotational moment about a center of the eccentric portion 41 of the shaft 4. This rotational moment acts on the piston 9 in a direction of rotation of the shaft 4 and is supported by the distal end 11A of the vane 11. Accordingly, frictional resistance forces are exerted as reaction forces of this support force on contact points 201 and 202 between the vane 11 and the vane groove 10, thus increasing a sliding loss that is generated by the reciprocating motion of the vane 11 within the vane groove 10. In the rotary compressor of this kind, in order to reduce the sliding loss to reduce an input loss, it is preferable to minimize the viscous force of the oil acting between the eccentric portion 41 of the shaft 4 and the inner peripheral surface 9B of the piston 9 by reducing areas of the sliding surfaces between the eccentric portion 41 of the shaft 4 and the inner peripheral surface 9B of the piston 9 or by reducing a sliding speed of one of the eccentric portion 41 of the shaft 4 and the inner peripheral surface 9B of the piston 9 relative to the other.

PATENT DOCUMENTS(S)

Patent Document 1: JP 2008-180178 A

SUMMARY OF INVENTION

Problems to be Solved by the Invention

In this conventional disclosure, after the eccentric portion 41 of the shaft 4 has been formed, the piston 9 is mounted on the eccentric portion 41 of the shaft 4 from the side of the auxiliary bearing 8. To this end, a diameter of an auxiliary shaft 43 inserted into the auxiliary bearing 8 is smaller than that of a main shaft 42 inserted into the main hearing 7, and an outer peripheral surface of the eccentric portion 41 of the shaft 4 on the side adjacent to a center of the shaft 4 is flush with or located radially outwardly of an outer peripheral surface of the auxiliary shaft 43 inserted into the auxiliary bearing 8. Accordingly, assuming that a diameter of the eccentric portion 41 of the shaft 4 is represented by ϕD1, that of the auxiliary shaft 43 inserted into the auxiliary bearing 8 is represented by ϕD3, and an amount of eccentricity of the eccentric portion 41 is represented by E, the diameter ϕD1 of the eccentric portion 41 of the shaft 4 is represented by:

$$\phi D1 \geq \phi D3 + 2 \times E \quad (1).$$

That is, the diameter ϕD1 of the eccentric portion 41 must be so determined as to satisfy the formula (1). Also, because the diameter ϕD2 of the main shaft 42 is greater than the diameter of the auxiliary shaft 43, the outer peripheral surface of the eccentric portion 41 on the side adjacent to the center of the shaft 4 is located radially inwardly of an outer peripheral surface of the main shaft 42.

In this conventional disclosure, it is conceivable that the diameter of the eccentric portion 41 is reduced to reduce the area of the sliding surface of the eccentric portion 41, but if the amount of eccentricity of the eccentric portion 41 is the same, the diameter of the auxiliary shaft 43 must be further reduced with a reduction in diameter of the eccentric portion 41. As a result, the strength of the auxiliary shaft 43 in particular becomes insufficient, thus posing a problem of reducing the reliability.

It is also conceivable that the diameter of the entire shaft 4 including the main shaft 42 is reduced, but the strength of the entire shaft 4 similarly becomes insufficient, thus posing a problem of reducing the reliability.

The present invention has been developed to overcome the above-described disadvantages. It is accordingly an objective of the present invention to provide a low-input loss rotary compressor capable of reducing a sliding loss, which is caused by a reciprocating motion of a vane within a vane groove, by reducing a diameter of an eccentric portion of a shaft while maintaining the strength reliability of the shaft.

Means to Solve the Problems

In order to solve the problems inherent in the prior art, the rotary compressor according to the present invention includes a cylinder, a main bearing and an auxiliary bearing secured respectively to opposite end surfaces of the cylinder to define a cylinder chamber, a shaft having an eccentric portion formed between the main bearing and the auxiliary bearing, a piston mounted on the eccentric portion of the shaft, and a vane loosely inserted in a vane groove defined in the cylinder for a reciprocating motion thereof, the vane partitioning the cylinder chamber into a suction chamber and a compression chamber. An outer peripheral surface of the eccentric portion of the shaft on a side adjacent to a center of the shaft is located radially inwardly of an outer peripheral surface of a main shaft inserted in the main bearing and that of an auxiliary shaft inserted in the auxiliary bearing. Also, a back clearance means used in mounting the piston on the shaft is provided in each of an inner peripheral surface of the piston and the eccentric portion of the shaft.

Effects of the Invention

The above-described configurations can ensure the strength reliability of the shaft and reduce the diameter of the eccentric portion, thus making it possible to reduce areas of sliding surfaces between the eccentric portion of the shaft and the inner peripheral surface of the piston and also reduce a sliding speed of one of the eccentric portion of the shaft and the inner peripheral surface of the piston relative to the other. That is, during rotation of the shaft, it becomes possible to reduce a viscous force of oil acting between the eccentric portion of the shaft and the inner peripheral surface of the piston and also reduce a rotational moment about the center of the eccentric portion of the shaft, which rotational moment is caused by the viscous force of the oil and acts on the piston in a direction of rotation of the shaft. Accordingly, during the reciprocating motion of the vane within the vane groove, it is possible to reduce frictional resistance forces exerted on two contact points between the vane and the vane groove as reaction forces of a support force when the distal end of the vane supports the rotational moment. As a result, a sliding loss caused by the reciprocating motion of the vane within the vane groove can be reduced, thus making it possible to provide a low-input loss rotary compressor.

DESCRIPTION OF EMBODIMENTS

Figure 1:
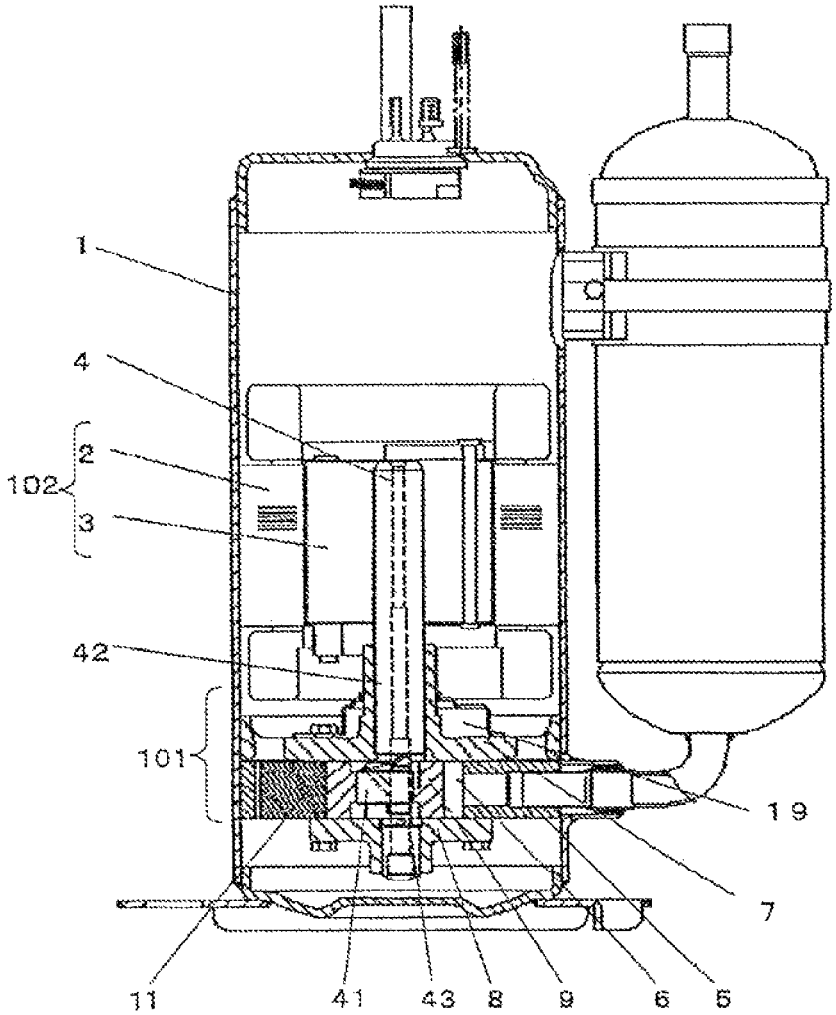
FIG. 1 is a vertical sectional view of a rotary compressor according to a first embodiment of the present invention.

A first invention is directed to a rotary compressor that includes a cylinder, a main bearing and an auxiliary bearing secured respectively to opposite end surfaces of the cylinder to define a cylinder chamber, a shaft having an eccentric portion formed between the main bearing and the auxiliary bearing, a piston mounted on the eccentric portion of the shaft, and a vane loosely inserted in a vane groove defined in the cylinder for a reciprocating motion thereof, the vane partitioning the cylinder chamber into a suction chamber and a compression chamber and having a distal end hingedly connected to the piston. An outer peripheral surface of the eccentric portion of the shaft on a side adjacent to a center of the shaft is located radially inwardly of an outer peripheral surface of a main shaft inserted in the main bearing and that of an auxiliary shaft inserted in the auxiliary bearing. Also, a back clearance means used in mounting the piston on the shaft is provided in each of an inner peripheral surface of the piston and the eccentric portion of the shaft.

The above-described configurations can ensure the strength reliability of the shaft and reduce the diameter of the eccentric portion, thus making it possible to reduce areas of sliding surfaces between the eccentric portion of the shaft and the inner peripheral surface of the piston and also reduce a sliding speed of one of the eccentric portion of the shaft and the inner peripheral surface of the piston relative to the other. That is, during rotation of the shaft, it becomes possible to reduce a viscous force of oil acting between the eccentric portion of the shaft and the inner peripheral surface of the piston and also reduce a rotational moment about the center of the eccentric portion of the shaft, which rotational moment is caused by the viscous force of the oil and acts on the piston in a direction of rotation of the shaft. Accordingly, during the reciprocating motion of the vane within the vane groove, it is possible to reduce frictional resistance forces exerted on two contact points between the vane and the vane groove as reaction forces of a support force when the distal end of the vane supports the rotational moment.

In the rotary compressor according to the first invention, a second invention is such that one of an end surface of the main bearing and an end surface of the auxiliary bearing is held in sliding contact with an end surface of the eccentric portion of the shaft to support a thrust load acting on the shaft.

This feature can reduce a gap formed between an outer peripheral surface of the piston, which swings and orbits within the cylinder chamber with one of the end surface of the main bearing and that of the auxiliary bearing as a reference plane of the orbital motion of the piston, and the inner peripheral surface of the cylinder while minimizing whirling of the shaft. Accordingly, leakage of a gas refrigerant from the compression chamber to the suction chamber can be reduced to thereby obtain the effect of the first invention without reducing a volumetric efficiency.

In the rotary compressor according to the first or second invention, a third invention is such that the back clearance means of the piston is formed by cutting away a sliding surface of the inner peripheral surface of the piston confronting the eccentric portion of the shaft on a side of the suction chamber in the cylinder chamber.

Because the cutaway portion formed in the inner peripheral surface of the piston is positioned on the side of the suction chamber in the cylinder chamber, i.e., on a lightly-loaded side, the piston 9 is less affected by the influence of, for example, seizing on the sliding surface thereof confronting the eccentric portion of the shaft and, accordingly, the reliability is not lowered.

In the rotary compressor according to the third invention, a fourth invention is such that the back clearance means of the piston is formed by cutting away a sliding surface of the inner peripheral surface of the piston confronting the eccentric portion of the shaft from a position of 30 degrees in a direction of rotation of the shaft, starting from one of intersections between the inner peripheral surface of the piston and a centerline of the vane in a thickness direction close to the vane when the vane has been retracted deepest into the vane groove.

Because the starting position of the cutaway portion formed in the inner peripheral surface of the piston is shifted by 30 degrees from a base point of the lightly-loaded portion, sufficient durability can be ensured even if a load is applied to a location adjacent to the base point of the lightly-loaded portion during a discharge process.

In the rotary compressor according to the third or fourth invention, a fifth invention is such that the piston is disposed to perform an orbital motion while swinging on a horizontal plane and the back clearance means thereof is formed by cutting away an upper side of the sliding surface of the inner peripheral surface of the piston confronting the eccentric portion of the shaft.

Because the cutaway portion formed in the sliding surface of the piston confronting the eccentric portion of the shaft functions as an oil sump, poor lubrication that may be caused by a shortage of oil can be avoided, thus making it possible to enhance the reliability.

In the rotary compressor according to any one of the first to fifth inventions, a sixth invention is such that a single-component refrigerant mainly comprising hydrofluoroolefin having a carbon-carbon double bond or a mixture refrigerant containing this refrigerant is used as a refrigerant. When such a refrigerant is used, the lubricating ability is lowered in association with a reduction in chemical stability, in particular, at high temperatures and, hence, the sliding loss caused by the reciprocating motion of the vane within the vane groove can be more effectively reduced.

Embodiments of the present invention are described hereinafter with reference to the drawings, but the present invention is not limited to the embodiments.

Embodiment 1

Figure 2:
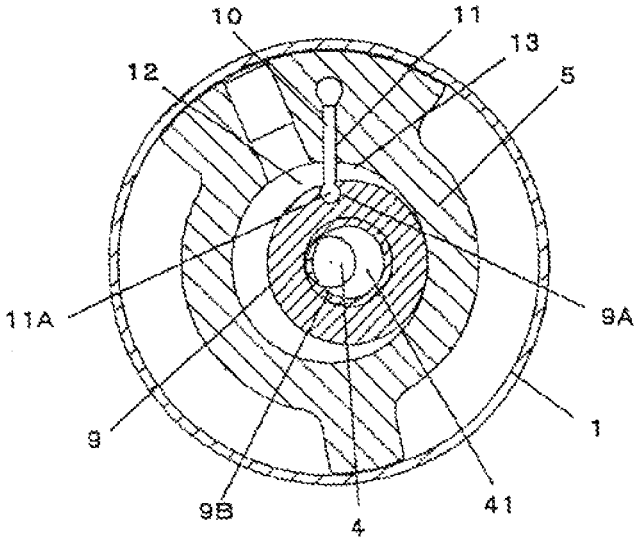
FIG. 2 is a transverse sectional view of a compression mechanism mounted in the rotary compressor of FIG. 1.

FIG. 1 is a vertical sectional view of a rotary compressor embodying the present invention and including a compression mechanism 101 and FIG. 2 is a transverse sectional view of the compression mechanism 101.

The rotary compressor shown in FIG. 1 includes a closed cylindrical container 1, an electric motor 102 accommodated within the closed container 1 at an upper portion thereof, and the compression mechanism 101 disposed below and driven by the electric motor 102. An oil sump is formed in the closed container 1 at a bottom portion thereof.

The electric motor 102 includes a ring-shaped stator 2 secured to an inner peripheral surface of the dosed container 1 at an upper portion thereof and a rotor 3 loosely inserted into the stator 2 with a slight gap therebetween. The rotor 3 is secured to a vertically extending shaft 4 positioned at a central portion thereof.

As shown in FIGS. 1 and 2, the compression mechanism 101 includes a cylinder 5 having a radially extending vane groove 10 defined therein, a main hearing 7 and an auxiliary bearing 8 secured respectively to opposite end surfaces of the cylinder 5 to define a cylinder chamber 6, a shaft 4 having an eccentric portion 41 formed between the main bearing 7 and the auxiliary bearing 8, a piston 9 mounted on the eccentric portion 41 of the shaft 4, and a vane 11 loosely inserted in the vane groove 10 for a reciprocating motion thereof. The vane 11 has a circular arc distal end 11A hingedly connected to a joint 9A formed in the piston 9 to partition the cylinder chamber 6 into a suction chamber 12 and a compression chamber 13. Also, the main bearing 7 and the auxiliary bearing 8 are bolted to upper and lower end surfaces of the cylinder 5, respectively, and the main bearing 7 is welded to the closed container 1 to thereby secure the compression mechanism 101 to the closed container 1.

The construction of the shaft 4 and that of the piston 9 are explained hereinafter in detail with reference to the drawings.

Figure 3:
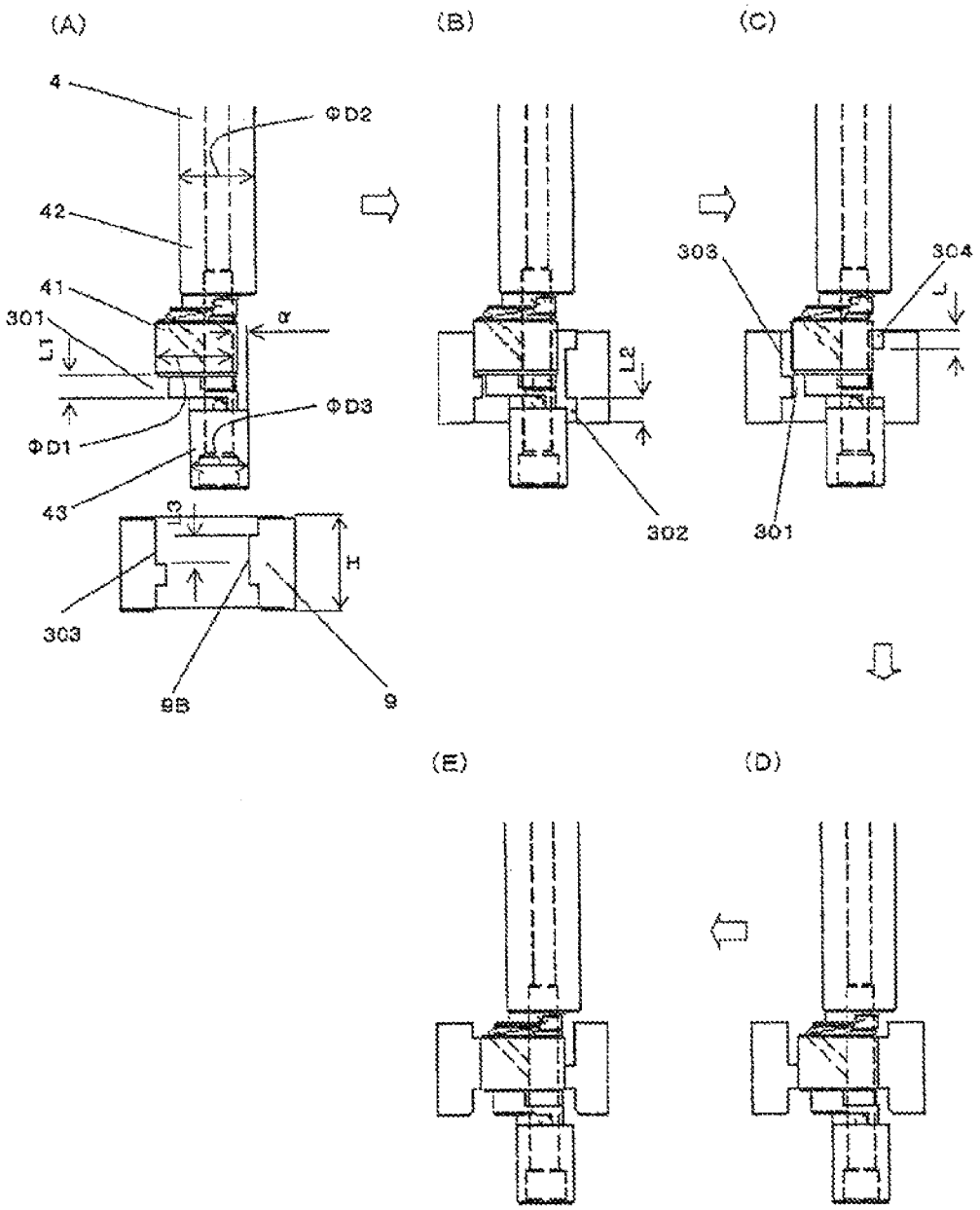
FIGS. 3(A) to 3(E) are an assembling process chart showing assemblage of a shaft and a piston both mounted in the rotary compressor of FIG. 1.

In the compression mechanism 101, the shaft 4 is generally made up of the main shaft 42 inserted into the main bearing 7, the eccentric portion 41 on which the piston 9 is mounted, and the auxiliary shaft 43 inserted into the auxiliary bearing 8. As shown in FIG. 3, the diameter $\phi$D3 of the auxiliary shaft 43 inserted into the auxiliary bearing 8 is smaller than the diameter $\phi$D2 of the main shaft 42 inserted into the main bearing 7, but the strength required for the auxiliary shaft 43 may be smaller than the strength required for the main shaft 42, and the shaft 4 has a sufficient strength as a whole. Also, the diameter of the eccentric portion 41 is $\phi$D1 and an outer peripheral surface of the eccentric portion 41 on the side adjacent to a center of the shaft 4 is located radially inwardly of an outer peripheral surface of the main shaft 42 and that of the auxiliary shaft 43. Specifically, the outer peripheral surface of the eccentric portion 41 is located radially inwardly of that of the auxiliary shaft 43 by a length $\alpha$. Also, the eccentric portion 41 has a back clearance or recess 301 defined therein, which acts as a back clearance means in mounting the piston 9 on the shaft 4, by cutting away an outer peripheral portion of the eccentric portion 41 on the side of the auxiliary bearing 8 radially inwardly from the outer peripheral surface of the eccentric portion 41 and concentrically with the auxiliary shaft 43 in a circular arc shape by a height L1. In this configuration, an end surface of the eccentric portion 41 is held in sliding contact with that of the auxiliary bearing 8 to thereby support a thrust load acting on the shaft 4. The eccentric portion 41 also has another recess defined therein by similarly cutting away an outer peripheral portion thereof on the side of the main bearing 7 radially inwardly from the outer peripheral surface of the eccentric portion 41 and concentrically with the main shaft 42 in a circular arc shape. The eccentric portion 41 further has a hole defined therein to communicate the recess, i.e., a space formed by cutting away the eccentric portion 41 with a through-hole defined in the shaft 4. In consideration of a manufacturing process of the shaft 4, a joint between the eccentric portion 41 and the main shaft 42 has a diameter smaller than that of the main shaft 42, and a joint between the eccentric portion 41 and the auxiliary shaft 43 similarly has a diameter smaller than that of the auxiliary shaft 43.

Figure 4:
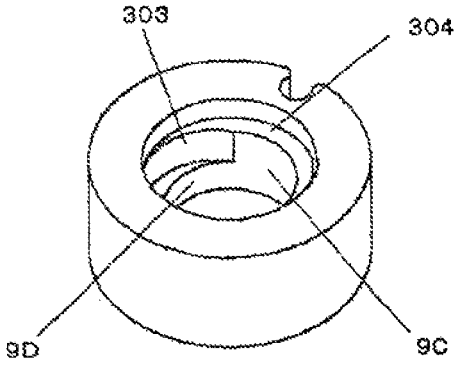
FIG. 4 is an enlarged perspective view of the piston of the rotary compressor of FIG. 1.

The piston 9 is so disposed as to perform an orbital motion while swinging on a horizontal plane. As shown in FIGS. 3 and 4, the piston 9 has a height H and a back clearance or recess 302 defined therein, which acts as a back clearance means in mounting the piston 9 on the shaft 4, by cutting away an inner peripheral portion thereof on the side of the auxiliary bearing 8 concentrically with an inner peripheral surface 9B thereof in a circular shape by a height L2. In addition, the eccentric portion 41 has another back clearance or recess 303 defined therein, which acts as a back clearance means in mounting the piston 9 on the shaft 4, by cutting away a sliding surface thereof on the side of the main bearing 7 confronting the eccentric portion 41 of the shaft 4 in a circular arc shape around a position shifted a requisite length from a center of the inner peripheral surface 9B of the piston 9 to an eccentric axis side by a height L3.

That is, as shown in FIG. 3(B), the piston 9 is moved toward the shaft 4 from the side of the auxiliary bearing 8 so that the auxiliary shaft 43 may be inserted into the piston 9 and, as shown in FIG. 3(C), the piston 9 is then moved toward the eccentric axis side by the length $\alpha$. Thereafter, as shown in FIG. 3(D), the piston 9 is moved toward the side of the main shaft 42 and mounted on the eccentric portion 41 and, as shown in FIG. 3(E), the piston 9 is rotated so that the back clearance 303 formed in the sliding surface thereof confronting the eccentric portion 41 of the shaft 4 may be positioned on the side of the suction chamber 12 in the cylinder chamber 6. In this embodiment, a recess 304 is formed in the piston 9 on the side of the main bearing 7 by concentrically cutting away the inner peripheral surface 9B of the piston 9 in a circular shape of a diameter equal to or less than that of the back clearance 302 by a height L so that a uniform pressure may be applied to upper and lower end surfaces of the piston 9. In this case, the cutaway height L1 of the back clearance 301, the cutaway height L2 of the back clearance 302 and the cutaway height L3 of the back clearance 303 are determined to satisfy the following formula (2):

$$L1>H-L-L2-L3 \quad (2).$$

Figure 5:
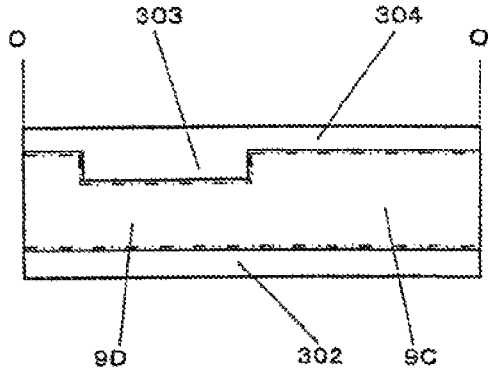
FIG. 5 is a developed view of an inner peripheral surface of the piston of the rotary compressor of FIG. 1.

FIG. 5 is a developed view of the inner peripheral surface 9B of the piston 9 when the inner peripheral surface 9B of the piston 9 has been developed in a direction of rotation of the shaft 4, starting from one of intersections between the inner peripheral surface 9B of the piston 9 and a centerline of the vane 11 in a thickness direction close to the vane 11 when the vane 11 has been retracted deepest into the vane groove 10. In FIG. 5, the sliding surface of the piston 9 confronting the eccentric portion 41 of the shaft 4 is sandwiched between two double-dotted chain lines and includes a narrowed portion 9D, which has been narrowed in a height direction by the provision of the back clearance 303, and a broad portion 9C that is broader than the narrowed portion 9D. In particular, the narrowed portion 9D is positioned on the side of the suction chamber 12 in the cylinder chamber 6 and formed by cutting away the inner peripheral surface of the piston 9 on the upper side thereof from a position of 30 degrees in the direction of rotation of the shaft 4, starting from one of the intersections between the inner peripheral surface 9B of the piston 9 and the centerline of the vane 11 in the thickness direction close to the vane 11 when the vane 11 has been retracted deepest into the vane groove 10.

Operation of the rotary compressor of the above-described construction is explained with reference to FIG. 6.

Figure 6:
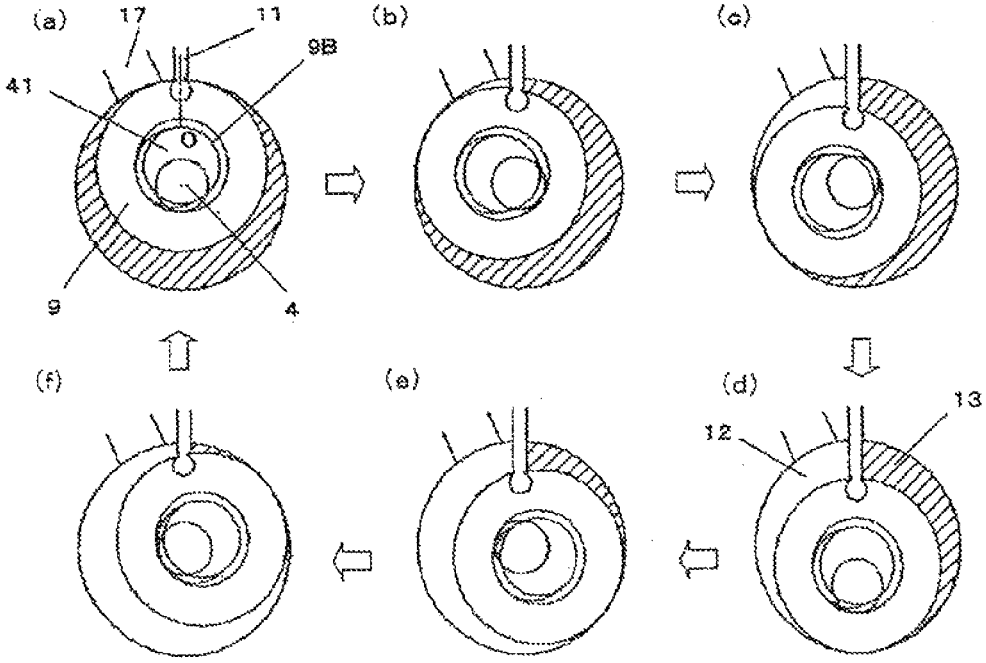
FIGS. 6(*a*) to 6(*f*) are schematic views to explain operation of the rotary compressor of FIG. 1.
Figure 7:
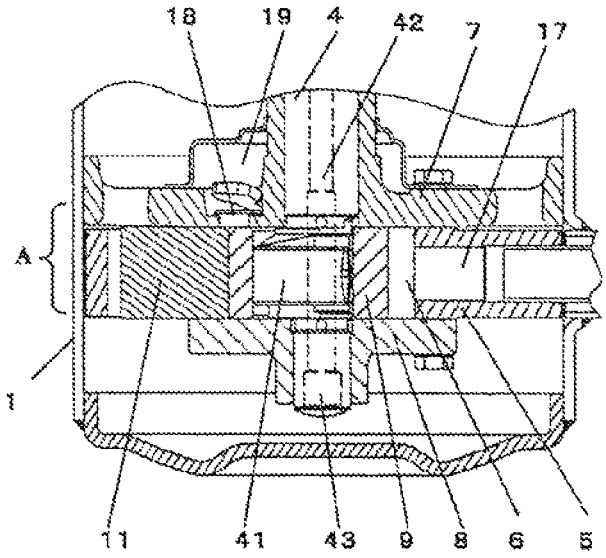
FIG. 7 is a vertical sectional view of a conventional rotary compressor.
Figure 8:
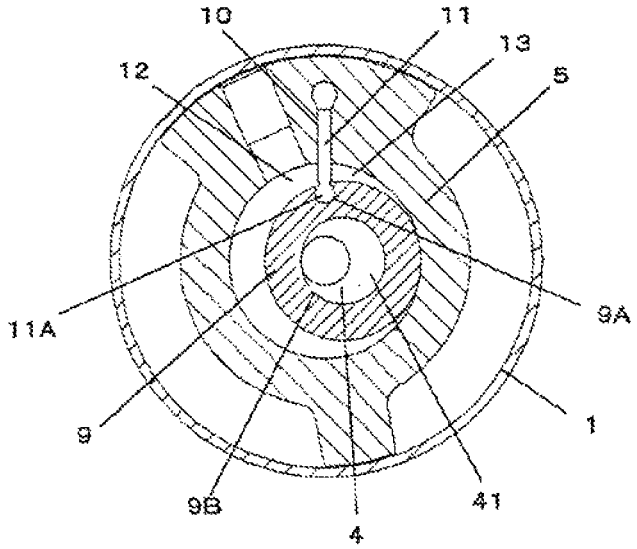
FIG. 8 is a transverse sectional view of a compression mechanism mounted in the conventional rotary compressor.
Figure 9:
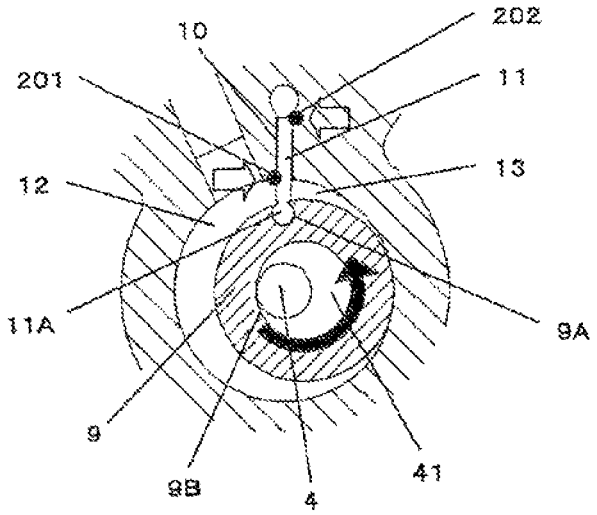
FIG. 9 is a schematic view to explain operation of an essential portion of the conventional rotary compressor.

FIG. 6 depicts positional relationships between the piston 9 and the vane 11 in the order of (a), (b), (c), (d), (e) and (f) when the piston 9 has been orbited in increments of 60 degrees. A working refrigerant is inhaled into the suction chamber 12 through the suction port 17 in the order of (a), (b), (c), (d), (e) and (f) in FIG. 3. Rotation of the shaft 4 is followed by an orbital motion of the piston 9 and a reciprocating motion of the vane 11, both of which in turn cause a change in volume of the suction chamber 12 and a change in volume of the compression chamber 13. Such volumetric changes gradually compress the working refrigerant into a high-temperature and high-pressure refrigerant, which is discharged from the compression chamber 13 into the closed container 1 through a discharge port (not shown) and a discharge muffler chamber 19 at the time of FIG. 6(*f*). At the same time, oil stored in the oil sump is sucked by an oil pump mounted on a lower end of the shaft 4 and passes through the through-hole defined in the shaft 4. The oil is then supplied to and lubricates sliding surfaces in the compression mechanism.

In the above-described embodiment, the rotary compressor has the following configurations:

the diameter of the auxiliary shaft 43 is smaller than that of the main shaft 42, the outer peripheral surface of the eccentric portion 41 on the side adjacent to the center of the shaft 4 is located radially inwardly of that of the main shaft 42 and that of the auxiliary shaft 43, in order to be able to easily mount the piston 9 on the shaft 4, the back clearance 301 is formed in the eccentric portion 41 of the shaft 4 by cutting away an outer peripheral portion of the eccentric portion 41 on the side of the auxiliary bearing 8 radially inwardly from the outer peripheral surface of the eccentric portion 41 and concentrically with the auxiliary shaft 43 in a circular arc shape by a height L1, the back clearance 302 is formed in the piston 9 by cutting away an inner peripheral portion thereof on the side of the auxiliary bearing 8 concentrically with the inner peripheral surface 9B thereof in a circular shape by a height L2, and the back clearance 303 is formed in the eccentric portion 41 of the shaft 4 by cutting away a sliding surface thereof on the side of the main bearing 7 confronting the eccentric portion 41 in a circular arc shape around a position shifted a requisite length from the center of the inner peripheral surface 9B of the piston 9 to the eccentric axis side by a height L3.

The above-described configurations can ensure the strength reliability of the shaft 4 and reduce the diameter of the eccentric portion 41, thus making it possible to reduce areas of the sliding surfaces between the eccentric portion 41 of the shaft 4 and the inner peripheral surface 9B of the piston 9 and also reduce a sliding speed of one of the eccentric portion 41 of the shaft 4 and the inner peripheral surface 9B of the piston 9 relative to the other. That is, during rotation of the shaft 4, it becomes possible to reduce a viscous force of the oil acting between the eccentric portion 41 of the shaft 4 and the inner peripheral surface 9B of the piston 9 and also reduce a rotational moment about the center of the eccentric portion 41 of the shaft 4, which rotational moment is caused by the viscous force of the oil and acts on the piston 9 in a direction of rotation of the shaft 4. Accordingly, during the reciprocating motion of the vane 11 within the vane groove 10, it is possible to reduce frictional resistance forces exerted on the aforementioned two contact points between the vane 11 and the vane groove 10 as reaction forces of a support force when the distal end 11A of the vane 11 supports the rotational moment.

Also, because an end surface of the eccentric portion 41 of the shaft 4 is held in sliding contact with that of the auxiliary bearing 8 to thereby support a thrust load acting on the shaft 4, it is also possible to reduce a gap formed between the outer peripheral surface of the piston 9, which swings and orbits within the cylinder chamber 6 with the end surface of the auxiliary bearing 8 as a reference plane of the orbital motion of the piston 9, and the inner peripheral surface of the cylinder 5 while minimizing whirling of the shaft 4. Accordingly, leakage of a gas refrigerant from the compression chamber 13 to the suction chamber 12 can be reduced to thereby avoid a reduction in volumetric efficiency. Further, because the narrowed portion 9D of the sliding surface of the inner peripheral surface 9B of the piston 9 confronting the eccentric portion 41 of the shaft 4 is positioned on the side of the suction chamber 12 in the cylinder chamber 6, i.e., on the side of a light load, the piston 9 is less affected by the influence of, for example, seizing, thus making it possible to reduce the viscous force of the oil acting between the eccentric portion 41 of the shaft 4 and the inner peripheral surface 9B of the piston 9.

That is, during the orbital motion of the piston 9 from a state of FIG. 6(*a*) to a state of FIG. 6(*d*), the sliding surface of the inner peripheral surface 9B of the piston 9 on the side of the suction chamber 12 confronting the eccentric portion 41 of the shaft 4 is a lightly-loaded portion and the load is accordingly very light. Also, during the orbital motion of the piston 9 from the state of FIG. 6(*d*) to the state of FIG. 6(*a*), a load is applied to the sliding surface of the inner peripheral surface 9B of the piston 9 on the side of the compression chamber 13 confronting the eccentric portion 41 of the shaft 4, but the load applied to the sliding surface on the side of the suction chamber 12 is very light. Accordingly, the sliding surface of the inner peripheral surface 9B of the piston 9 on the side of the suction chamber 12 confronting the eccentric portion 41 of the shaft 4 is a lightly-loaded portion. Also, in order to ensure sufficient durability even if a load is applied to a location adjacent to a base point of the lightly-loaded portion during a discharge process, a starting angle of the narrowed portion 9D is shifted 30 degrees from a base point O of the intersections between the inner peripheral surface 9B of the piston 9 and the centerline of the vane 11 in the thickness direction close to the vane 11 when the vane 11 has been retracted deepest into the vane groove 10 and, hence, the reliability is not lowered. Further, because the narrowed portion 9D is formed by cutting away an upper side of the piston 9 and because the cutaway portion formed in the sliding surface confronting the eccentric portion 41 of the shaft 4 functions as an oil sump, poor lubrication that may be caused by a shortage of oil can be avoided, thus making it possible to enhance the reliability.

The above-described construction can ensure the strength reliability of the shaft 4 and reduce the diameter of the eccentric portion 41 without reducing the reliability when one of the inner peripheral surface of the piston and the eccentric portion of the shaft slides relative to the other, thus making it possible to reduce the areas of the sliding surfaces between the eccentric portion of the shaft and the inner peripheral surface of the piston and also reduce the sliding speed of one of the eccentric portion of the shaft and the inner peripheral surface of the piston relative to the other. That is, during rotation of the shaft, it becomes possible to reduce the viscous force of the oil acting between the eccentric portion of the shaft and the inner peripheral surface of the piston and also reduce the rotational moment about the center of the eccentric portion of the shaft, which rotational moment is caused by the viscous force of the oil and acts on the piston in the direction of rotation of the shaft. Accordingly, during the reciprocating motion of the vane within the vane groove, it is possible to reduce frictional resistance forces exerted on the aforementioned two contact points between the vane and the vane groove as reaction forces of a support force when the distal end of the vane supports the rotational moment. As a result, a sliding loss caused by the reciprocating motion of the vane within the vane groove can be reduced, thus making it possible to provide a low-input loss rotary compressor.

In the rotary compressor according to this embodiment, in applications where a single-component refrigerant mainly comprising hydrofluoroolefin having a carbon-carbon double bond or a mixture refrigerant containing this refrigerant is used as a refrigerant, the lubricating ability is lowered in association with a reduction in chemical stability, in particular, at high temperatures and, hence, the sliding loss caused by the reciprocating motion of the vane within the vane groove can be more effectively reduced.

INDUSTRIAL APPLICABILITY

As described above, because the rotary compressor according to the present invention can reduce the input loss, it can be used as a compressor for a water heater or an air compressor.

EXPLANATION OF REFERENCE NUMERALS

1 closed container
2 stator
3 rotor
4 shaft
5 cylinder
6 cylinder chamber
7 main bearing
8 auxiliary bearing
9 piston
9A joint
9B inner peripheral surface
9C broad portion
9D narrowed portion
10 vane groove
11 vane
11A distal end
12 suction chamber
13 compression chamber
17 suction port
18 discharge port
19 discharge muffler chamber
41 eccentric portion
42 main shaft
43 auxiliary shaft
101 compression mechanism
102 electric motor
201 contact point
202 contact point
301 back clearance
302 hack clearance
303 back clearance
304 recess

The invention claimed is:

1. A rotary compressor comprising:

a cylinder having opposite end surfaces and a vane groove defined therein;

a main bearing and an auxiliary bearing secured to the opposite end surfaces of the cylinder, respectively, to define a cylinder chamber;

a shaft having an eccentric portion formed between the main bearing and the auxiliary bearing, the shaft having a main shaft inserted in the main bearing and an auxiliary shaft inserted in the auxiliary bearing;

a piston mounted on the eccentric portion of the shaft; and a vane loosely inserted in the vane groove for a reciprocating motion thereof, the vane partitioning the cylinder chamber into a suction chamber and a compression chamber and having a distal end hingedly connected to the piston;

wherein an outer peripheral surface of the eccentric portion of the shaft on a side facing an opposite side to an eccentric direction is located radially inwardly of an outer peripheral surface of the main shaft and that of the auxiliary shaft;

wherein the piston has a first back clearance portion defined in an inner peripheral surface thereof and the eccentric portion of the shaft has a second back clearance portion defined therein;

wherein the first back clearance portion of the piston further comprises:

a first part formed by cutting away an inner peripheral portion of the piston on a side of the auxiliary bearing concentrically with the inner peripheral surface of the piston in a circular shape, and a second part formed by cutting away the sliding surface of the piston on the side of the main bearing confronting the eccentric portion of the shaft in a circular arc shape, the second part being shifted with respect to a center of the inner peripheral surface of the piston to the eccentric direction, and disposed on a side of the suction chamber in the cylinder chamber;

wherein the second back clearance portion of the eccentric portion further comprises:

a third part formed by cutting away the outer peripheral portion of the eccentric portion on the side of the auxiliary bearing radially inwardly from the outer peripheral surface of the eccentric portion and concentrically with the auxiliary shaft in a circular arc shape, and a fourth part formed by cutting away the outer peripheral portion of the eccentric portion on the side of the main bearing radially inwardly from the outer peripheral surface of the eccentric portion and concentrically with the main shaft in a circular arc shape; and wherein the outer peripheral surface of the eccentric portion of the shaft on the side facing the opposite side to the eccentric direction is located radially inwardly of the outer peripheral surface of the auxiliary shaft by a first length, the circular shaped recess of the first part has the first length in depth, and the piston is mounted on the shaft by moving the piston toward the shaft from the side of the auxiliary bearing so as to insert the auxiliary shaft into the piston, and then by moving the piston toward the eccentric direction by the first length while utilizing the first and second back clearance portions.

2. The rotary compressor according to claim 1, wherein one of an end surface of the main bearing and an end surface of the auxiliary bearing is held in sliding contact with an end surface of the eccentric portion of the shaft to support a thrust load acting on the shaft.

3. The rotary compressor according to claim 1, wherein the second part is formed by cutting away the sliding surface of the inner peripheral surface of the piston confronting the eccentric portion of the shaft from a position of 30 degrees in a direction of rotation of the shaft, starting from one of intersections between the inner peripheral surface of the piston and a centerline of the vane in a thickness direction close to the vane when the vane has been retracted deepest into the vane groove.

4. The rotary compressor according to claim 1, wherein the piston is disposed to perform an orbital motion while swinging on a horizontal plane.

5. The rotary compressor according to any one of claim 1, wherein a single-component refrigerant mainly comprising hydrofluoroolefin having a carbon-carbon double bond or a mixture refrigerant containing this refrigerant is used as a refrigerant.

* * * * *